US005343599A

United States Patent [19]

Reeves

[11] Patent Number: 5,343,599

[45] Date of Patent: Sep. 6, 1994

[54] EYEGLASSES HOLDER

[76] Inventor: Rudolph E. Reeves, 6650 Mariner Dr. #201, Racine, Wis. 53406

[21] Appl. No.: 963,428

[22] Filed: Oct. 19, 1992

[51] Int. Cl.[5] ..... A45F 5/00

[52] U.S. Cl. ..... 24/36

[58] Field of Search ..... 24/3 R, 3 C, 3 E, 3 F, 24/3 G, 563, 342, 30.5 S, 49 TS; 248/317

[56] References Cited

U.S. PATENT DOCUMENTS

| | | | |
|---|---|---|---|
| 12,771 | 3/1908 | Dripps . | |
| 730,663 | 6/1903 | Jordan . | |
| 2,637,080 | 5/1953 | Nemser . | |
| 2,641,760 | 6/1953 | Syracuse | 24/3 E X |
| 3,357,070 | 12/1967 | Sloan | 24/30.5 S X |
| 3,820,200 | 6/1974 | Myers | 24/30.5 S |
| 3,956,795 | 5/1976 | Kosakai . | |
| 4,157,166 | 6/1979 | Voelker | 248/317 |
| 4,452,354 | 6/1984 | Tabachnick . | |
| 4,644,610 | 2/1987 | Fish | 24/30.5 S |
| 5,033,612 | 7/1991 | Bivins . | |
| 5,052,083 | 10/1991 | Hammer | 24/49 R |

FOREIGN PATENT DOCUMENTS

| | | | |
|---|---|---|---|
| 28981 | 5/1981 | European Pat. Off. | 24/3 C |
| 234027 | 5/1925 | United Kingdom | 24/3 R |

*Primary Examiner*—James R. Brittain
*Attorney, Agent, or Firm*—Jansson & Shupe, Ltd.

[57] ABSTRACT

An apparatus for holding eyeglasses, with one or more temples, including a substantially planar member with means for removable attachment to a protruding clothing portion and means for removable reception of a temple to secure the eyeglasses when not in use. Preferred embodiments of the apparatus include a slit-like aperture for clothing attachment and a dimensionally self-adjusting member for grasping an eyeglass temple. The one-piece design promotes durability and allows unworn eyeglasses to be held inconspicuously and close the wearer's person. The holder may be easily removed and/or concealed when not in use.

3 Claims, 1 Drawing Sheet

EYEGLASSES HOLDER

FIELD OF THE INVENTION

This invention is related generally to eyeglasses holders and, more particularly, to effective, durable holding and attachment mechanisms.

BACKGROUND OF THE INVENTION

Over the years, eyeglasses have evolved beyond means for vision correction or protection from sunlight. A fashion element has emerged, to the extent that eyeglasses are often considered as an accessory to a particular clothing ensemble. This evolution is underscored by the growing use of the term "eyewear" to denote eyeglasses which assist in creating a desired fashion statement.

Recent trends include a movement toward informal appeal as appropriate for a variety of occasions. The development of eyeglass lenses and frames made from durable, resilient materials allows them to be treated in the same manner and obviates the necessity of storing them in protective cases or containers. As a result, eyeglasses are often an accessory to casual attire and attached to an article of clothing or otherwise exposed when not in use.

The search for an effective holder for eyeglasses has been an on-going concern in the art. Many previous devices utilize a stick or safety pin-like attachment mechanism joined to an ornamental member configured to hold eyeglasses to an article of clothing. Other such devices include string-like assemblies ending in two contracting loops which pass over and tighten around the eyeglass temples. Examples of such well-known holder devices are disclosed in U.S. Pat. Nos. 3,956,795, 5,033,612, and 4,458,384.

However, the prior art has associated with it a number of significant problems and efficiencies. Most are related to inadequate performance or appearance and result from the attachment and/or holding mechanisms of such devices currently used.

One major problem is that string-type devices of the prior art are bothersome in that the eyeglasses, when not in use, hang from the wearer's neck. Bending forward causes the eyeglasses to drop vertically, away from the wearer's body, interfering with his or her movement or bringing the them in contact with foods or beverages. The same situation may create the potential for personal injury in the presence of power tools and the like.

A related problem is that when the eyeglasses are worn the string remains attached thereto. Under certain circumstances and depending upon individual taste, the string may be considered inappropriate and/or unsightly.

Another problem relates to the contracting loops found on the ends of such strings. Repeated on/off movement of the eyeglasses, as well as the weight thereof, invariably causes the loops to loosen and the eyeglasses to fall.

With respect to the pin-type holders of the prior art, such devices are comprised of multiple individual parts, any of which may break or malfunction. Manufacturing costs render these devices relatively expensive. Safety is an additional concern in that the wearer may be injured either during attachment or as a result of a malfunction. The clothing article to which such devices are attached is often ill-suited to pin-attachment. The weight of the eyeglasses may stretch and pull the fabric and/or leave holes therein.

In summary, a considerable number of drawbacks and problems exist in the art relating to eyeglass holders. There is a need for an eyeglass holder which protects eyeglasses from damage, is appropriate with either formal or casual attire, and provides the accessibility and convenience appreciated under any set of circumstances.

OBJECTS OF THE INVENTION

It is an object of this invention to provide an eyeglasses holder overcoming some of the problems and shortcomings of the prior art.

Another object of this invention is to provide an eyeglasses holder which does not impede or hinder movement when in use and holding the eyeglasses.

Another object of this invention is to provide an eyeglasses holder which quickly and efficiently engages the eyeglasses and may be removed when not in use.

Another object of this invention is to provide an eyeglasses holder such that the number of moveable, component parts is reduced to a minimum, thereby reducing cost of manufacture and the potential for mechanical failure.

Another object of this invention is to provide an eyeglasses holder which alleviates the safety and apparel-wear concerns associated with pin-type mechanisms.

These and other important objects will be apparent from the descriptions of this invention which follow.

SUMMARY OF THE INVENTION

This invention is a device for holding eyeglasses and the like. It overcomes certain well-known problems and efficiencies, including those outlined above.

An important aspect of this invention is an improved grasping mechanism, including a preferred self-adjusting, converging finger portion configuration. The inventive apparatus holds the eyeglasses securely, close to the person, when not in use. The overall design and arrangement of the grasping and attachment members provides for a minimum number of moveable component parts, ensuring long-term use and durability.

This invention is a device for holding eyeglasses with one or more temples to a protruding clothing portion including (1) a substantially planar member having opposed first and second surfaces, (2) means removeably engaging said member to a protruding clothing portion for attachment thereto, and (3) means removeably receiving a temple to secure the eyeglasses when not in use.

In preferred embodiments, the attachment means is a aperture between the first and second surfaces. In highly-preferred embodiments, the aperture is a slit having opposed ends wherein one end of the slit is wider in cross-dimension than the opposed end and has a substantially circular configuration.

In preferred embodiments, the securing means is also an aperture between the first and second surfaces. The securing means may also comprise a dimensionally self-adjusting grasping member. In highly-preferred embodiments, the grasping member is a plurality of substantially converging finger portions, bounded by a plurality of slits, each slit intersecting the others at a point substantially one-half the length dimension of each.

As already noted, this invention has certain advantages. The one-piece design and construction minimizes manufacturing costs, prevents mechanical failure, and ensures an extended functional life. The placement of the clothing attachment means proximate to the securing means prevents dangling or side-to-side motion of the eyeglasses, which impede or otherwise hinder a full-range of personal movement. Furthermore, the unique grasping member self-adjusts to a variety of temple dimensions, thus immobilizing and securing the eyeglasses within the holder.

When attached to a clothing button or like fastener, the invention disclosed herein holds eyeglasses inconspicuously and close to the wearer's person. When the eyeglasses are worn, the holder may be quickly and easily removed and placed in a pocket or elsewhere out of sight, until needed again. In such a manner the holder may be utilized even in situations which require formal attire.

Because the holder does not rely on multiple, moveable components, repeated use will not lead to a mechanical failure which could cause the eyeglasses to fall. The inventive grasping member mechanism accommodates a wide range of temple dimensions, adjusting to and grasping the temple in a pinching manner as it is received therein. Eyeglasses are thus secured within the holder device with a minimal of internal movement.

As mentioned above, in highly-preferred embodiments, the attachment means is a slit arranged and configured to accommodate a protruding clothing portion, such as a button. Once slipped over the button, the holder of this invention rests upon the thread or similar such means attaching the button to the clothing article. In this manner, the weight of and pressure caused by eyeglasses placed within the holder is confined to that part of the clothing article best able to sustain it. As a result, the inventive holder may be used with expensive and/or delicate clothing without concern over pin holes and stretched fabric.

DETAILED DESCRIPTIONS OF THE PREFERRED EMBODIMENTS

The figures illustrate an eyeglasses holder apparatus which is a preferred embodiment of this invention. The light-weight, compact, yet durable, apparatus holds eyeglasses securely when not in use.

Figure 1:
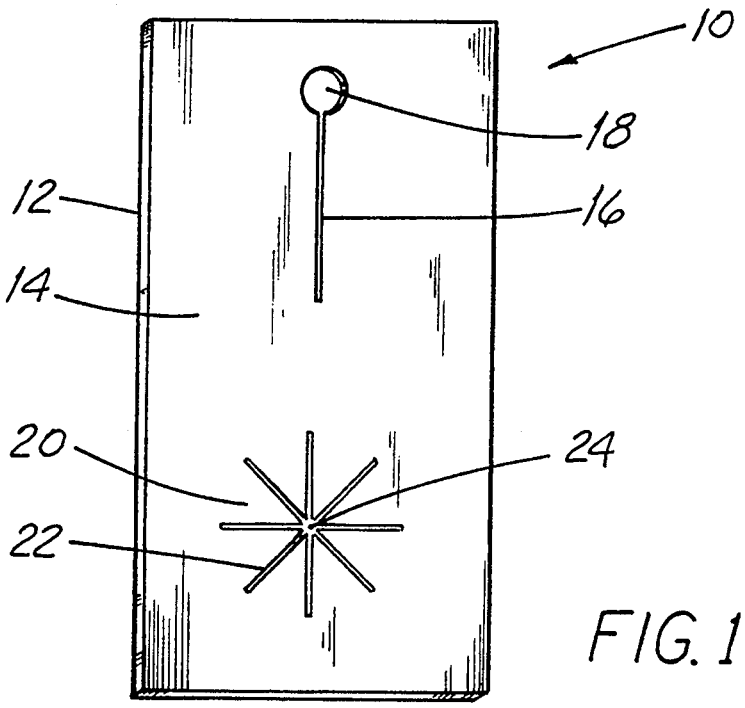
FIG. 1 is a full prospective view of the preferred eyeglasses holder device, in accordance with this invention.

As best shown in FIG. 1, holder 10 has opposed surfaces 12 and 14, respectively. The attachment means is comprised of slit 16 which widens at the one end thereof to become a substantially circular passage 18 between opposed surfaces 12 and 14. Slit 16 and passage 18 may be placed over and around a clothing button or the like such that the holder is attached thereto. The circular configuration of passage 18 interacts in a complimentary manner with the thread attaching the button to the cloth.

Eyeglasses are held, when not worn, by a plurality of substantially converging finger portions 20, which are bound by a plurality of slits 22, each of which intersects the others at a point substantially one-half its length dimension. The intersection of slits 22 forms aperture 24 extending between surfaces 12 and 14, through which an eyeglass temple is positioned.

Figure 2:
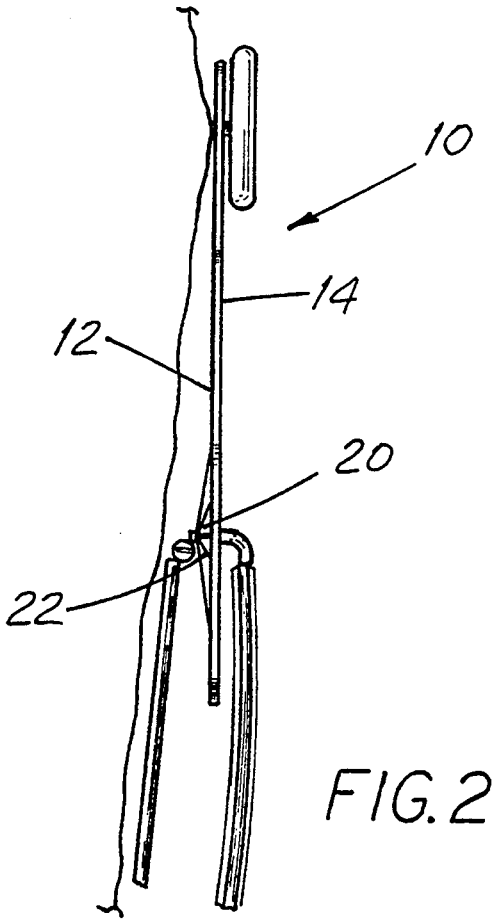
FIG. 2 is a side-view of the holder device, showing attachment to a protruding clothing portion and eyeglasses held by the grasping means.

As best shown in FIG. 2, holder 10 may be attached to a protruding clothing portion, such as a button. Eyeglasses are secured within holder 10 by placing a temple portion through aperture 24 and within grasping means 20 which dimensionally self-adjusts around the temple securing it and preventing movement within holder 10.

Acceptable material choices for holder 10 will be apparent to those skilled in the art and aware of this invention. A somewhat rigid, yet flexible polymeric material is preferred, one which resists bending along the holder midline and maintains the eyeglasses close to the body, even when the person is bent forward. Flexibility and resiliency are desired with respect to finger portions 20 such that they allow an eyeglass temple to be placed therein, but conform around and grasp it once received. Holder 10 may also incorporate a variety of pigments to promote fashion coordination, or may be transparent so as to remain inconspicuous when attached to an article of clothing.

While the principles of this invention have been described in connection with specific embodiments, it should be understood clearly that these descriptions are made only by way of example and are not intended to limit the scope of the invention. For example, the inventive holder may be used in conjunction with ballpoint or fountain pens, as well as other like devices when a pocket or another holder is either inconvenient or unavailable. Likewise, the holder of this invention may be used in conjunction with a of variety protrusions outside the clothing context, including dashboard knobs, drawer handles, and the like. Furthermore, where such protrusions are not available, one may be provided on a string or loop assembly, worn around a person's neck, which incorporates a button-like feature.

I claim:

1. A clothing-supported eyeglass suspension involving accessible securement of eyeglasses by eyeglass temple member insertion, comprising in combination:

clothing having an exposed button;

a substantially planar holder, all of which is in a single plane, such planar holder including a button aperture therethrough for removable engagement with the button at a first position on the holder and a self-adjusting aperture through the holder at a second position, said self-adjusting aperture including a plurality of slits, each said slit having a length dimension and intersecting the others at a point substantially halfway along said slit dimension; and a pair of eyeglasses having one temple member fully inserted only through the self-adjusting aperture.

2. The combination of claim 1 wherein the button aperture is a button slit, said button slit having opposite ends one of which is wider in cross-dimension than the other.

3. The combination of claim 2 wherein the wider end comprises a substantially circular passage through said holder.

* * * * *